US005460283A

United States Patent [19]

MaCartney et al.

[11] Patent Number: 5,460,283

[45] Date of Patent: Oct. 24, 1995

[54] SEALING CLOSURE CAP

[76] Inventors: Charles T. MaCartney, 83 Hollywood Crescent, Toronto, Ontario, Canada, M4L 2K4; Victor A. Daykin, 729 Pebble Court, Pickering, Ontario, Canada, L1V 3Z5

[21] Appl. No.: 365,989

[22] Filed: Dec. 28, 1994

Related U.S. Application Data

[63] Continuation of Ser. No. 91,508, Jul. 14, 1993, abandoned, which is a continuation-in-part of Ser. No. 645,854, Jan. 25, 1991, abandoned, which is a continuation-in-part of Ser. No. 845,777, Mar. 4, 1992, abandoned.

[51] Int. Cl.[6] ..... B65D 53/00

[52] U.S. Cl. ..... 215/270; 215/320; 215/329; 215/341; 215/354

[58] Field of Search ..... 215/270, 341, 215/344, 329, 320, 321, 354

[56] References Cited

U.S. PATENT DOCUMENTS

| | | | |
|---|---|---|---|
| 2,965,256 | 12/1960 | Yochem | 215/344 X |
| 3,165,227 | 1/1965 | Crowell et al. | 220/355 |
| 3,209,934 | 10/1965 | Salminen | 215/320 |
| 3,297,184 | 1/1967 | Andelin . | |
| 3,298,415 | 1/1967 | Klygis | 150/0.5 |
| 3,330,433 | 7/1967 | Salminen . | |
| 3,692,208 | 9/1972 | Croyle et al. | 220/24.5 |
| 4,206,852 | 6/1980 | Dunn et al. | 215/252 |
| 4,341,320 | 7/1982 | Libit | 215/341 |
| 4,771,905 | 9/1988 | Perne et al. | 215/270 |
| 4,844,961 | 7/1989 | Akao | 428/36.92 |

*Primary Examiner*—Stephen P. Garbe
*Assistant Examiner*—Vanessa Caretto
*Attorney, Agent, or Firm*—Caesar, Rivise, Bernstein, Cohen & Pokotilow, Ltd.

[57] ABSTRACT

A polyethylene cap, for use with containers, particularly polypropylene containers for containing medical specimens in preservative fluid such as formaldehyde, is provided with a 3-face seal, wherein a rim portion of the container is trapped in sealing, contacting relation on three mutually adjoining faces, whereby any tendency of the container rim to "relax" out of sealing engagement with a contacting face portion of the cap is effectively precluded by the fit and the geometry of the cap seal. In the case of polypropylene, which is susceptible to such "relaxation", the subject cap enables the effective sealing of polypropylene containers so that advantage may be taken of the superior properties of polypropylene in non-reactive, secure containment of possibly contaminated medical specimens in liquids such as formaldehyde, a known carcinogen.

11 Claims, 3 Drawing Sheets

SEALING CLOSURE CAP

This application is a continuation of pending application Ser. No. 08/091,508 filed Jul. 14, 1993 now abandoned, which is itself a continuation-inn-part of ASN 07/645,854 filed Jan. 25, 1991 now abandoned, and ASN 07/845,777, filed Mar. 4, 1992, now abandoned.

TECHNICAL FIELD

This invention is directed to the field of containers, and in particular to a container and sealing closure cap system particularly suited for the sealed enclosure of medical samples.

BACKGROUND ART

In the field of medicine the safe handling of medical specimens has assumed a new criticality.

The onset of acquired immune deficiency (AIDS) stemming from the highly contagious HIV virus, combined with greater awareness of the carcinogenic pathology of substances in common medical use, such as formaldehyde has created an urgent demand for sample storage jars or containers that are of reasonable cost, not susceptible to breakage or leakage, are readily sealed and unsealed, and are suited to disposal by incineration.

The inherent dangers of breakage of glass containers, and the probability of generating dangerously sharp shards upon the occurrence of breakage that are susceptible to spreading infection, allied with the difficulty of ready, economical, safe and permanent disposal of glass containers militates against their continued use.

In the vast array of the plastics family polypropylene possesses many of the sealing characteristics required in the field of medical use, possessing as it does the qualities of: high resistance to leakage; resilience (i.e. non-frangible under impact); highly resistant to chemical or biological infiltration; moderate cost; substantially inert; stable at the temperatures of normal use; may be relatively safely incinerated.

However, polypropylene possesses one inherent characteristic which generally renders it unsuitable for use where high integrity seals are necessary. That characteristic is the tendency, when elastically deformed at a pressure point constituting a seal interface, for the polypropylene to gradually "draw back" at the point of contact, thereby reducing the contact pressure at the seal interface, to thus impair or destroy the integrity of the seal.

In the medical field of use, this characteristic has substantially negated the possible use of polypropylene containers, at least for containment of potentially contaminated tissue samples.

In the case of pressurized containers such as glass bottles and plastic containers for carbonated drinks, sealed by use of screw caps, U.S. Pat. No. 4,206,852 Dunn et al., issued June 1980, teaches the use of a plastic cap, preferably of polypropylene.

The internal shaped recess in the crown of the Dunn et al. cap is inset, radially, having a deformable centre crown portion of the closure cap that is acted upon by internal gas pressure present within the bottle, to exert a deforming sealing force against a narrow annular sealing band where the cap bears against the interior of the bottle neck, using a so-called "Belleville spring" effect to generate the desired deforming force in response to applied gas pressure.

U.S. Pat. No. 4,771,905 Perne et al., issued September 1988, operates in similar fashion, the deformed cap bearing radially outwardly against a narrow inner surface of the convoluted bottle neck. Again, internal gas pressure provides the deforming force.

U.S. Pat. No. 4,341,320 Libit, issued July 1982, also is applied to necked containers, wherein the seal is applied internally of the bottle neck as a consequence of internal gas pressure. A complex, axially deformable crown portion also is involved, as a tamper tell-tale.

Other forms of non-screwed lip seals are to be found in U.S. Pat. Nos. 3,165,227 Crowell et al., issued Jan. 1965; 3,692,208 Croyle et al., issued September 1972; and 4,844,961 Akao, issued July 1989, which rely upon deforming respective members of the container/closure combination.

DISCLOSURE OF INVENTION

The present invention provides a rim seal closure cap suitable for use with a polypropylene container to provide sealing between the closure cap and a peripheral rim portion of the container. The cap has a peripheral groove on the inside face thereof to receive the container rim in axially inserted, grounded relation therein, the groove having opposing side portions and an end portion in adjoining relation with the side portions, the opposing side portions each making sustained pressing contact with the container rim to provide long term sustained sealing of the container by the closure cap.

The present invention thus provides, in combination a rim seal wide mouth closure screw-cap for use in removable combination with a wide mouth substantially unpressurized plastic container having a plain cylindrical upstanding rim of predetermined radial thickness and a plain annular top lip, located axially outwardly of a threaded neck portion; the wide mouth screw-cap having a lower annular skirt portion containing a thread form to mate with the container threaded neck portion; an annular recess of substantially rectangular section within the cap having a substantially planar inner end face with a radial width less than the predetermined plain rim radial width to provide an interference fit of the upstanding rim and the top lip when grounded in the annular cap recess to provide sealing contacting relation on three mutually adjoining faces of the convergent annular surface therein to receive the rim in converging, compressing relation therewith; the cap having a substantially rigid central crown position, and an arcuately-profiled flexible annular portion connecting the central crown portion with the convergent annular surface, to apply a radially acting, resilient reactive force against the convergent annular surface to resist penetration of the rim therepast, and to maintain the loading against the rim.

The cap groove is undersized, relative to the lip of the container rim, such that, while avoiding a requirement for high closure torque when applying the cap to fully engage the rim, a residual compressive force is maintained on the end face and adjoining sides of the container lip to sustain sealing engagement between cap, and container.

In the preferred embodiment the closure cap includes mechanical retaining means in use to secure the closure cap in axially secured relation with the container rim, preferably in the form of a single start thread.

The use of polyethylene for the cap ensures that stiffness of the cap contact surfaces is such that in the case of a polypropylene container, the sealing surfaces are maintained in long term sealing engagement.

In the case of a cylindrical container the mechanical cap retaining means preferably comprises a single start screw thread form of a full 360° extent, to exert adequate axial force on the cap, relative to the container, upon relative rotation therebetween, so as to fully seat the cap in grounded, sealing relation against the rim of the container.

The cap grooved recess which is penetrated by the container rim is provided with inclined entry surfaces that apply progressively increasing lateral pressure against the sides of the oversize rim as it penetrates to the bottom of the recess and becomes "grounded" in the recess. This lateral pressure effects a residual seal compression, despite the "relaxing" tendency of the polypropylene container rim, over time.

The cap grooved recess is effectively "centered" in relation to the container rim, so that until sealing contact occurs, substantially simultaneously with both inner and outer edges of the rim lip, the cap permits the discharge of air being displaced by the penetration of the cap.

The cap requires approximately one full turn (360° ) from initial engagement of the threads to the final "bottoming" of the container rim in compressed sealing engagement within the groove of the cap.

The final sealing phase of cap placement, after expulsion of air from the container is terminated, occupies approximately 90° of cap rotation, to the fully engaged, sealing and "bottomed" condition of the container rim within the cap recess. As a consequence, the capped and sealed container is closed effectively at atmospheric pressure.

The provision within the cap of a curved offset, preferably of U-section, connecting the inside flank of the cap groove with the central portion of the cap, provides resilient reactive loading to the inside flank, so as to operate in the manner of a compression spring of effectively constant rate, to thereby maintain sealing pressure of the groove inside flank against the inside face of the container rim.

In view of the substantially rigid nature of the encompassing crown portion of the cap, this "spring action" of the curved section adjoining the inner flank serves to maintain substantially constant contact loading on both inner and outer flank faces of the container rim, thereby sustaining the integrity of the seal.

The screw-on torque requirement characteristics of the cap-container combination is sufficiently uniform for production containers, and of such reasonable repeatability that the application of the caps to the containers may be automated, by the use of a cap-applying machine, thus facilitating a reduction in costs.

Thus, in the preferred embodiment the axial annular end or lip portion of the container rim makes sealing contact with the adjacent "bottom" surface of the cap groove, thereby providing three adjoining surfaces of the container rim in sealing engagement with the respective three adjoining surfaces of the cap groove.

In the case of a cap according to the present invention in combination with a container of polypropylene, this effectively precludes relaxation of the container rim in seal compromising withdrawal from the sealing surfaces of the cap.

The present invention thus provides in combination a rim seal closure screw-cap, for use in removable combination with a widemouthed plastic container having a plain cylindrical upstanding rim of predetermined radial thickness and a plain annular top lip located axially outwardly of a threaded neck portion of the container; the screw-cap having a lower annular skirt portion containing a thread form to mate with the container threaded neck portion; an annular recess within the cap having on inner end face with a radial width at the innermost face thereof less than the predetermined radial width of the container rim, to provide an interference fit of the container rim and top lip when grounded therein; the cap annular recess having a tapered entry mouth with at least one inwardly convergent annular surface therein, in use to receive the container rim in converging, compressing relation therewith; the cap having a substantially rigid central crown portion, and an arcuately profiled flexible annular portion connecting the central crown portion with the convergent annular surface, to apply a radially acting, resilient reactive force against the convergent annular surface to resist penetration of the container rim therepast, and to maintain side loading by the cap against the rim in sealing engagement therebetween.

In the preferred embodiment the cap and the container each has a single start thread. The single start thread preferably subtends an angle of at least about 360°.

In use, with the cap screwed onto the container, with a full turn of threaded engagement therebetween, the lip of the container rim is grounded within the cap recess, having three adjoining faces of the container rim each in compressed sealing relation with three adjoining faces of the cap annular recess.

The invention further provides the aforesaid sealing cap in combination with the aforesaid widemouthed container, the container rim having an interference fit with the cap annular recess.

It has been found that selection of the aforesaid interference fit permits the requirement of moderate closing torque in applying the cap to the container, thereby permitting automated assembly of the screw-cap to the container.

The subject closure cap may be of polyethylene, and is of particular use in that prolonged sealing integrity may be achieved using containers of polypropylene, wherein the usual "relaxing away" of the polypropylene container from its sealing pressure points is effectively overcome.

The adoption of an interference fit wherein the container rim is ten thousandths (0.010 inches) to fifteen thousandths (0.015 inches) greater in radial width than the cap annular recess achieves the desired degree of high integrity, prolonged sealing, while requiring a sufficiently low cap-applying torque to enable the capping operation to be automated.

In the preferred combination having a 360° single start thread engagement the cap is spaced from the rim, when three quarters turned in closing relation upon the threads, a distance sufficient to permit ventilation of air past the container rim. This is achieved by use of a thread having an axial pitch equal to substantially four times the depth of the cap annular recess.

The further closure of the cap to a fully engaged sealing relation with the container requires substantially a further one quarter turn to ground the rim in the cap recess.

BRIEF DESCRIPTION OF DRAWINGS

Certain embodiments of the invention are described by way of illustration, without limitation of the invention thereto, reference being made to the accompanying drawings, wherein.

BEST MODE OF CARRYING OUT THE INVENTION

Figure 1:
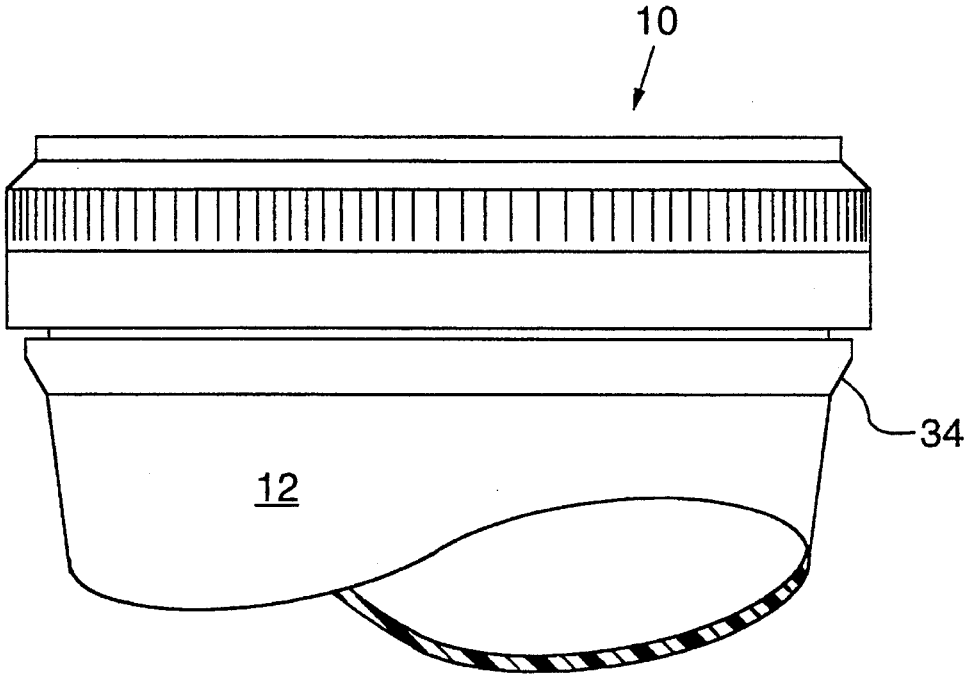
FIG. 1 is a side view of a cap in accordance with the present invention, mounted on a rim portion of a cylindrical container.

The most convenient form of container and closure cap combination is of circular section, as illustrated in the drawings.

In FIG. 1 there is illustrated a polyethylene closure cap 10 and a portion of a polypropylene container 12.

Figure 2:
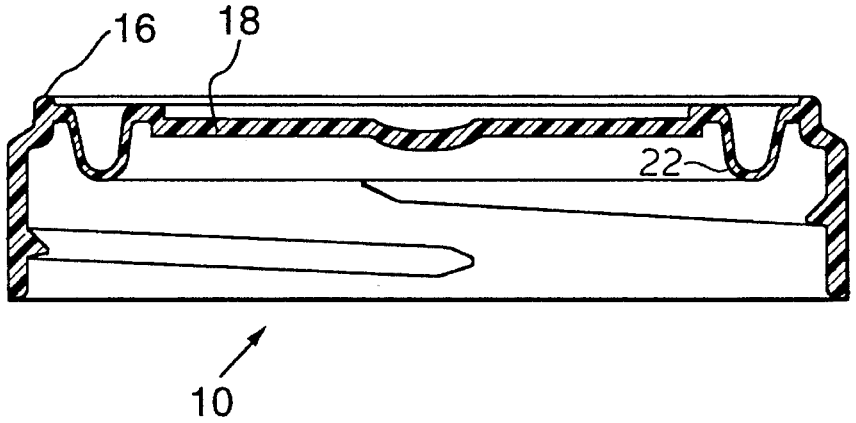
FIG. 2 is a diametrical section of the closure cap of FIG. 1.
Figure 3:
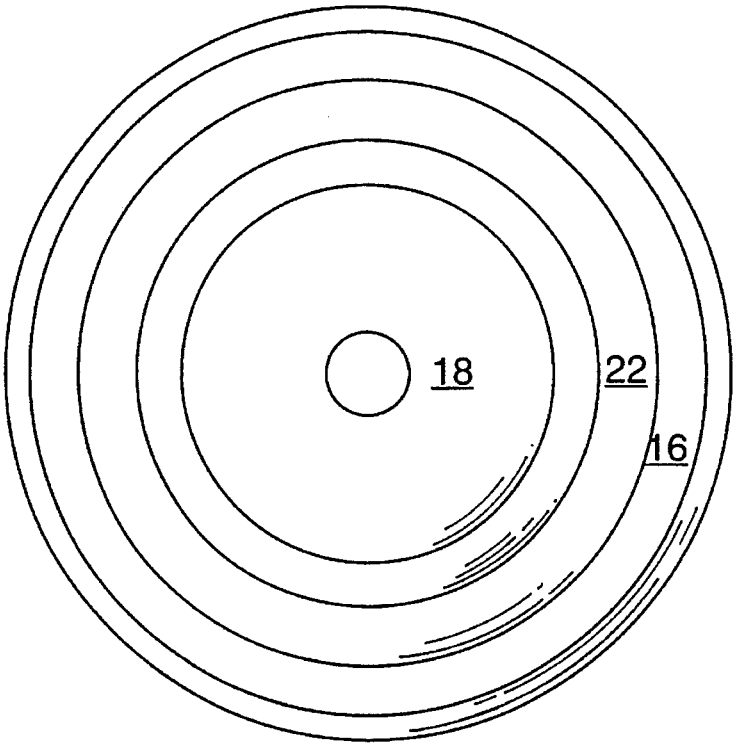
FIG. 3 is an exterior plan view of the closure cap of FIG. 1.
Figure 4:
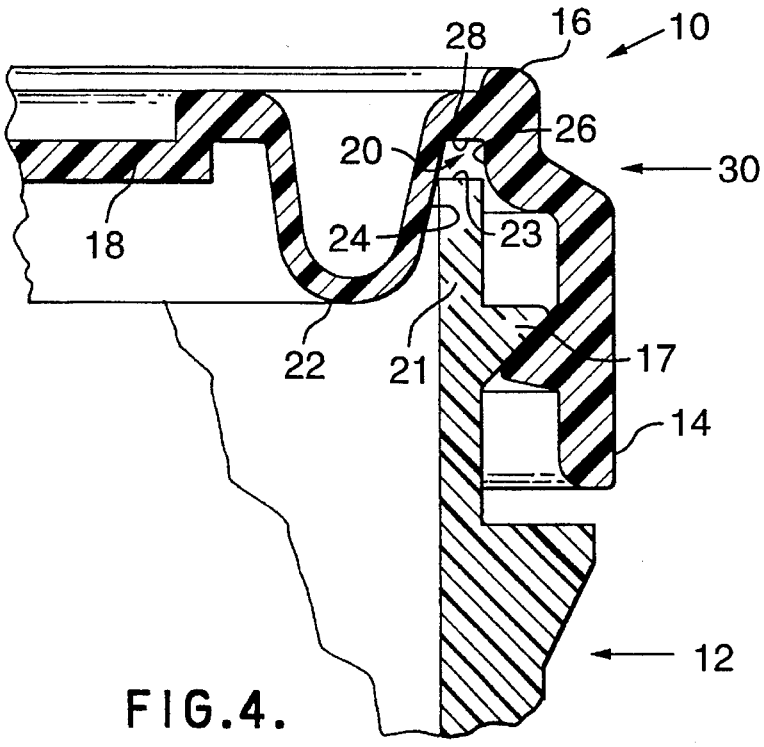
FIG. 4 is an enlarged view of a portion of FIG. 2, together with a rim portion of a container, in partially secured relation.

The cap 10, FIGS. 2 and 4, has a peripheral skirt portion 14, a top rib portion 16, a central dished portion 18 and an interior seal groove 20. The groove 20 has inclined inner flank 24, curved outer flank 26 and end wall 28.

A U-shaped connection portion 22 extends between the central dished portion 18 and the radially inner flank 24 of groove 20. The container 12 has an annular shoulder 15, a thread 17 extending 360° around the neck 19, and a plain cylindrical rim 21, with an annular end face 23.

The U-shaped section of connecting portion 22 of the cap 10 provides resilience to the seal inner flank 24, urging it radially outwardly against deflection thereof by container rim 21, exerting lateral compressive loading of the inner flank 24 against the inside of rim 21, which also serves to load the outside of rim 21 against the outer flank 26 of cap 10.

The top annular rib 16 of cap 10 serves as a stacking ring by which capped containers may be stacked. The rib 16 and adjacent underlying cap portion is of heavy section, providing a substantially rigid crown portion to the cap 10.

This rigidity affects the curved flank 26 which contacts the outside surface of rim 21.

Referring to FIG. 4, the location of the end face 23 of rim 21 in the position illustrated represents approximately three quarters of a turn of the cap 10 after engagement with the thread 17 of the container 12.

The laterally oversized lip 23 has slight radial clearances from the radially inner flank 24 and radially outer flank 26 of cap 10, by which the air displaced by portion 22 of the cap 10 entering the container 12 is free to escape beneath the cap 10.

Completion of rotation of the cap 10 by a further one quarter turn eases the lip 23 into jammed, bottomed relation against the annular end wall 28 of cap 10, in sealed relation therewith.

The curved face of the outer flank 26 operates as a cam surface, applying compressive inward radial pressure against the rim 21 of container 12.

The upper outer portion 30 of cap 10 is of a thick, relatively stiff section.

Upon closure of cap 10, other than the elastic compression of rim 21 and cap outer flank 26, there is a tendency for the stiff outer portion 30 of cap 10 to load radially inwardly against the rim 21. This in turn applies radial inward loading of the rim 21 against the inner flank 24 of cap 10.

A reactive spring-effect force is generated by the resilient connecting portion 22, to resist this radially inward deflection of the cap inner flank 24, resulting in an applied reactive load acting in compressive relation on the rim 21, in sealing relation therewith.

The provision of a rim 21 that is approximately "ten thousandths" (0.010 inches) to fifteen thousandths (0.015 inches) greater in radial width than the annular end wall 28 against which it is seated, together with the adoption of an offset radiused resilient section 22 to provide a substantially constant radial reaction force to the radial sealing forces acting upon the polypropylene rim 21 of container 12, promotes the provision of a long term seal that does not require unduly high torque forces to apply or undo. The moderate torque forces required enable the adoption of automated capping, using a cap-applying machine.

Figure 5:
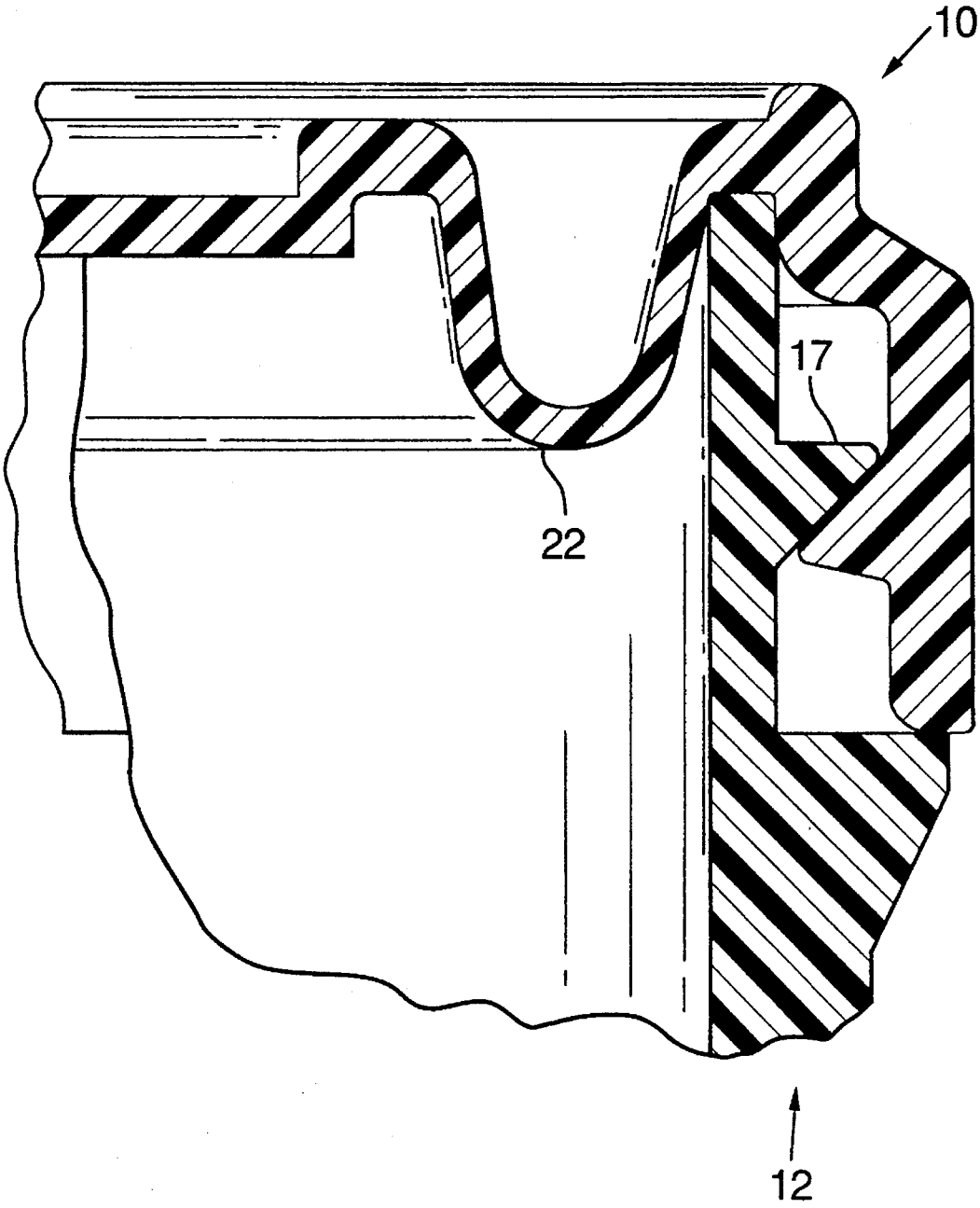
FIG. 5 is a view similar to FIG. 4, showing the container rim seated or grounded in the closure cap groove.

FIG. 5 shows the cap in the fully engaged sealing condition, having the rim 21 of the container 12 grounded against the bottom of the undersize recess 20 of the cap 10.

Rotation of the cap 10 produces axial displacement of container rim 21, relative to the seal groove 20, forcing the adjoining faces of the rim 30 into sustained sealing contact with the corresponding faces of the seal groove 20.

A tapered protrusion 34 of the container serves as a supporting bridge, to safeguard a label (not shown) applied thereover, against tearing due to an otherwise abrupt change in section constituted by the lower edge of closure cap 10

INDUSTRIAL APPLICABILITY

The presently disclosed sealing closure cap is particularly suited for use with plastic containers. It is particularly suited to surgical needs, as in hospitals. In particular, the closure cap is suited for use with plastic containers, and in particular is useful with polypropylene containers, for use in handling infections or carcinogous materials.

What is claimed:

1. In combination a rim seal wide mouth closure screw-cap, in removable combination with a wide mouthed substantially unpressurized plastic container having a plain cylindrical upstanding rim of predetermined radial thickness and a plain annular top lip, located axially outwardly of a threaded neck portion; said wide mouth screw-cap having a lower annular skirt portion containing a thread form to mate with said container threaded neck portion; an annular recess of substantially rectangular section within said cap having a substantially planar inner end face with a radial width less than said predetermined rim and top lip when grounded in said cap annular recess to provide sealing contacting relation between said recess and said rim as been inserted on three mutually adjoining faces of said recess; said cap annular recess having a tapered entry mouth with at least one convergent annular surface therein to receive said rim in converging, compressing relation therewith; said cap having a substantially rigid central crown portion, and an arcuately-profiled flexible annular portion connecting said central crown portion with said convergent annular surface, to apply a radially acting, resilient reactive force against said convergent annular surface to resist penetration of said rim therepast, and to maintain said loading against said rim.

2. The closure and container combination as set forth in claim 1, said cap having single start thread therein.

3. The closure and container combination as set forth in claim 1, having a single start thread therein subtending an angle of substantially 360°.

4. The closure and container combination as set forth in claim 1, said cap annular recess contacting three annular adjoining surfaces of said container rim in sealing relation therewith when said rim is grounded within said cap recess.

5. The closure and container combination as set forth in claim 1, said container rim having an interference fit with said cap annular recess.

6. The combination as set forth in claim 5, said interference fit requiring a moderate closing torque to permit automated application of said screw-cap to said container.

7. The combination as set forth in claim 5, wherein said container is of polypropylene.

8. The combination as set forth in claim 6, said interference fit ranging as high as 15 thousandths of an inch oversize of said rim, relative to the radial width of said cap annular recess.

9. The combination as set forth in claim 8, said interference fit comprising up to 10 thousandths of an inch.

10. The combination as set forth in claim 9, wherein said container is of polypropylene and said cap is of polyethylene.

11. The combination as set forth in claim 5, said container threaded neck having a substantially 360° thread turn thereon.

* * * * *